US005200302A

United States Patent [19]

Iwano

[11] Patent Number: 5,200,302

[45] Date of Patent: Apr. 6, 1993

[54] PROCESS FOR COATING DEVELOPMENT OF SILVER HALIDE COLOR PHOTOSENSITIVE MATERIAL

[75] Inventor: Haruhiko Iwano, Minami-Ashigara, Japan

[73] Assignee: Fuji Photo Film Co., Ltd., Kanagawa, Japan

[21] Appl. No.: 831,737

[22] Filed: Feb. 10, 1992

Related U.S. Application Data

[63] Continuation of Ser. No. 456,923, Dec. 26, 1989, abandoned.

[30] Foreign Application Priority Data

Dec. 26, 1988 [JP] Japan ..... 63-328753

[51] Int. Cl.[5] ..... G03C 7/30

[52] U.S. Cl. ..... 430/376; 430/403; 430/466; 430/467; 430/375

[58] Field of Search ..... 430/376, 403, 404, 207, 430/467, 466, 375

[56] References Cited

U.S. PATENT DOCUMENTS

| | | | |
|---|---|---|---|
| 3,265,501 | 8/1966 | Johnston | 430/404 |
| 3,615,482 | 10/1971 | Cronig | 430/467 |
| 3,623,868 | 11/1971 | Cronig | 430/467 |
| 4,066,457 | 1/1978 | Panisik et al. | 430/467 |
| 4,113,491 | 9/1978 | Deguchi et al. | 430/467 |
| 4,276,370 | 6/1981 | Taylor | 430/466 |
| 4,818,673 | 4/1989 | Ueda et al. | 430/502 |
| 4,830,949 | 5/1989 | DeRycke | 430/404 |
| 4,882,264 | 11/1989 | Kim et al. | 430/467 |
| 4,954,425 | 9/1990 | Iwano | 430/467 |

FOREIGN PATENT DOCUMENTS

| | | |
|---|---|---|
| 61-77851 | 4/1986 | Japan . |
| 61-80149 | 4/1986 | Japan . |

OTHER PUBLICATIONS

James, *The Theory of the Photographic Process,* 1977, pp. 315-320.

Cronig, "Viscous Processing Considerations", Jul. 1966 SPSE News, vol.9, No. 4, pp. 10-14.

*Primary Examiner*—Richard L. Schilling

*Attorney, Agent, or Firm*—Sughrue, Mion, Zinn, Macpeak & Seas

[57] ABSTRACT

A process for coating development of a silver halide color photosensitive material is provided which comprises coating the silver halide color photosensitive material with a color developer to form a thin film. This process is characterized in that a developer containing a p-phenylenediamine developing agent having a group capable of imparting hydrophilic properties which developer has an ionic strength of 0.8 or below and an electric potential of the immersion bath of −280 mV or below is applied to the photosensitive material to form a coating film which is at most 20 times as thick as the dry photosensitive layer of the photosensitive material.

11 Claims, No Drawings

PROCESS FOR COATING DEVELOPMENT OF SILVER HALIDE COLOR PHOTOSENSITIVE MATERIAL

This is a continuation of application Ser. No. 07/456,923 filed Dec. 26, 1989, abandoned.

BACKGROUND OF THE INVENTION

The present invention relates to a process for development wherein a color developer is coated onto a silver halide color photosensitive material such as a color paper or color negative film to form a thin film of the developer. In particular, the present invention relates to a process for development wherein only a small amount of a developer is used.

In the development of silver halide color photosensitive material, attempts have been made at reducing the quantity of the waste liquors by reducing the quantities of processing solutions such as a developer, bleaching solution and fixing solution as far as possible. To meet the purpose, there is proposed a process wherein a developer is coated onto the photosensitive material to reduce the quantity of the waste developer. This process includes Viscomat system wherein the processing solution is applied by a hopper-coating, Bimat system wherein a processing solution is applied to a web to form a thin layer and the web is put on the photosensitive material, etc. These methods are described in, for example, the 11th and the 12th paragraphs of 'Neblette's Handbook of Photography & Reprography', the seventh edition published by Von Nostrand Reinhold Co., N.Y. in 1977 and Japanese Patent Unexamined Published Application (hereinafter referred to as 'J. P. KOKAI') No. 61-202360. Although no waste developer is formed by these methods, a considerable thickness of the coated layer is required and the developer consumption cannot be reduced so much as desired. Other problems are that the developing reaction rate is low because of insufficient stirring of the developer and that the washing load is heavy.

SUMMARY OF THE INVENTION

Therefore, a primary object of the present invention is to provide a process for coating development of silver halide color photosensitive material; which makes it possible that the quantity of the developer used is smaller than that used in conventional coating development processes and, therefore, the quantity of the waste developer can be reduced greatly or no waste developer is formed and, in addition, the developing reaction rate is high and, therefore, the development can be conducted in a short period of time.

Other objects of the present invention will be clear from the following description and Examples.

The present invention has been completed on the basis of a finding that the above-described problems can be efficiently solved by applying a color developer containing a particular developing agent and having a particular ionic strength and a particular electric potential of the immersion bath to a photosensitive material to form a film having a predetermined thickness.

The present invention provides a process for coating development of a silver halide color photosensitive material by coating a silver halide color photosensitive material with a color developer to form a thin film, which comprises applying a developer containing a p-phenylenediamine developing agent having a group capable of imparting hydrophilic properties which developer has an ionic strength of 0.8 or below and an electric potential of the immersion bath of −280 mV or below to the photosensitive material to form a coating film which is at most 20 times, preferably at most 10 times, as thick as the photosensitive layer of the photosensitive material.

DESCRIPTION OF THE PREFERRED EMBODIMENT

According to the process of the present invention, the exposed photosensitive material is processed in a color developing step and is then processed by an ordinary method comprising, for example, a desilverization step, washing step with water and/or stabilization step and drying step. If necessary, the developed material can be further processed by the coating method. The steps will be described below.

Color developing step:

In this step, an aqueous solution of a p-phenylenediamine developing agent having a group capable of imparting hydrophilic properties is used as a color developer. The developing agent used is preferably a compound of the following general formula [I]:

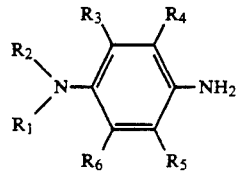

[I]

wherein $R_1$ and $R_2$ each represent a substituted or unsubstituted alkyl group and $R_3$, $R_4$, $R_5$ and $R_6$ each represent a hydrogen atom or a substituted or unsubstituted alkyl group, alkoxy group, sulfo group or carboxy group, or $R_1$ and $R_2$ may be bonded together to form a five- to seven-membered nitrogen-containing hetero ring, with the proviso that at least one of $R_1$ to $R_6$ represents a substituted alkyl or substituted alkoxy group having a group capable of imparting hydrophilic properties such as a hydroxyalkyl ($C_2$ to $C_4$), methanesulfonamidoalkyl ($C_2$ or $C_3$), $CH_2CH_2CO_2H$ or $CH_2CH_2SO_3H$.

Examples of these compounds include sulfates, hydrochlorides, p-toluenesulfonates and phosphates of 3-methyl-4-amino-N-ethyl-N-β-hydroxyethylaniline, 3-methyl-4-amino-N-ethyl-N-β-methanesulfonamidoethylaniline, 3-methyl-4-amino-N,N-di-β-hydroxyethylaniline, 3-β-methanesulfonamidoethyl-4-amino-N,N-diethylaniline, 3-sulfoethyl-4-amino-N,N-diethylaniline, 3-carboxyethyl-4-amino-N,N-diethylaniline and 3-methyl-4-amino-N-ethyl-N-sulfoethylaniline. They may be used either singly or in the form of a mixture of two or more of them.

The amount of the developing agent in the developer is usually at least 5 mM, preferably 0.01 to 0.2M and more preferably 0.02 to 0.1M. The higher the concentration of the developing agent, the smaller the amount of the developer to be applied to the photosensitive material. For example, a photosensitive material having a silver content of 0.8 g/m$^2$ and coating film thickness of 10μ can be developed by applying the developer having 0.1M concentration to form an approximately 40μ thick film.

The color developer used in the present invention has an ionic strength of 0.8 or below, preferably of 0.1 to 0.5. When the ionic strength is this low, the concentration of the color developer can be increased, the photosensitive material film can be rapidly swollen and the washing load can be reduced.

The ionic strength of the developer is represented by the following formula:

$$\frac{1}{2}\sum_{i} C_i Z_i^2$$

wherein Ci represents the activity (mol/l) of the ion in the developer and Zi represents the valency thereof. In the present invention, the activity in the above formula can be replaced with the concentration. Usually most color developers have an ionic strength of 1.0 to 2.5, since they contain a large amount of a pH buffering agent such as an alkali carbonate, alkali phosphate or alkali borate in order to stabilize them. On the contrary, in the present invention, the stabilization of the developer with such a large amount of pH buffering agent is unnecessary, since the disposable developer is applied each time. In addition, by reducing the ionic strength, the concentration of the developing agent can be increased, the silver halide emulsion film of the photosensitive material can be rapidly swollen and the washing load can be reduced.

In the present invention, the electric potential of the color developer bath is controlled to −280 mV or below, preferably −280 to −400 mV and more preferably −290 to −400 mV. The electric potential can be thus controlled by selecting the developing agent and pH.

By increasing the activity of the developer to higher than that of a developer used in an ordinary tank developing process, the thin layer-application developing process can be effectively conducted. The term 'electric potential of immersion bath' indicates the electric potential of the solution obtained when an unreactive electrode such as a platinum electrode is immersed in the color developer on the basis of the standard electrode (standard: SCE). When the color developer having an electric potential of immersion bath within the above-described range is used in the present invention, satisfactory development can be advantageously conducted even with a very small amount of the developer, as described above.

So far as the above-described requirements are satisfied, the color developer can contain a pH buffering agent such as an alkali metal carbonate, borate or phosphate; development inhibitor such as a bromide, iodide, benzimidazole, benzothiazole or mercapto compound; and an antifoggant. If necessary, the color developer may contain preservatives such as hydroxylamine, diethylhydroxylamine, sulfites, hydrazines, phenylsemicarbazides, triethanolamine, catecholsulfonic acids, triethylenediamine and 1,4-diazabicyclo[2,2,2]octanes; organic solvents such as ethylene glycol and diethylene glycol; development accelerators such as benzyl alcohol, polyethylene glycol, quaternary ammonium salts and amines; color-forming couplers; competing couplers; fogging agents such as sodium borohydride; auxiliary developing agents such as 1-phenyl-3-pyrazolidone; thickening agents; and chelating agents such as aminopolycarboxylic acids, aminopolyphosphonic acids, alkylphosphonic acids and phosphonocarboxylic acids, e.g. ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1, 1-diphosphonic acid, nitrilo-N,N,N-trimethylenephosphonic acid, ethylenediamine-N,N,N'-N'-tetramethylenephosphonic acid and ethylenediamine-di(o-hydroxyphenylacetic acid) as well as their salts.

In the reversal process, usually a black-and-white development is conducted prior to the color development. Known black-and-white developing agents such as dihydroxybenzenes, e.g. hydroquinone; 3-pyrazolidones, e.g. 1-phenyl-3-pyrazolidone and aminophenols, e.g. N-methyl-p-aminophenol are used either singly or in combination of two or more of them.

Usually the color developer used in the present invention requires no thickening agent. However, a thickening agent such as carboxymethylcellulose, hydroxymethylcellulose, hydroxyethylcellulose or acrylic polymer can be added thereto to control the viscosity thereof to 0.8 to 1000 cP.

The pH of the color developer is usually 9 to 12.

Bleaching and/or fixing process (desilverization process)

After the color development, a bleaching process is usually conducted, though it is not indispensable. The bleaching and fixing may be conducted either simultaneously (bleach-fixing process) or separately. To rapidly conduct the process, the bleaching process may be followed by the bleach-fixing process. Depending on the purpose, two successive bleach-fixing baths may be used or the bleach-fixing process may be followed by a fixing process. The bleaching and fixing may be conducted also by applying the bleaching and fixing solutions, respectively, to the material. The bleaching agents usable herein include, for example, compounds of polyvalent metals such as iron (III), cobalt (III), chromium (VI) and copper (II), peracids, quinones and nitro compounds. Typical examples of the bleaching agents include ferricyanides; bichromates; complex salts of iron (III) or cobalt (III) with organic compounds such as aminopolycarboxylic acids, e.g. ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, citric acid, tartaric acid and malic acid; persulfates; bromates; permanganates; and nitrobenzenes. Among these, the iron (III) complexes of aminopolycarboxylic acids such as iron (III) complex salt of ethylenediaminetetraacetic acid and the persulfates are preferred from the viewpoints of the rapid processing and prevention of environmental pollution. Further the iron (III) complexes of aminopolycarboxylic acids are particularly effective in both the bleaching solution and bleach-fixing solution. The pH of the bleaching solution or bleach-fixing solution containing iron (III) complex salt of aminopolycarboxylic acid is usually in the range of 5.5 to 8, but it may be made lower in order to conduct the process rapidly.

If necessary, a bleaching accelerator can be added to the bleaching solution, bleach-fixing solution and preprocessing baths. The bleaching accelerators usable herein include compounds having a mercapto group or disulfide linkage described in U.S. Pat. No. 3,893,858, West German Patent No. 1,290,812, J.P. KOKAI NO. 53-95630 and Research Disclosure No. 17,129 (July, 1978); thiazolidine derivatives described in J.P. KOKAI No. 50-140129; thiourea derivatives described in U.S. Pat. No. 3,706,561; iodides described in J.P. KOKAI No. 58-16235; polyoxyethylene compounds described in West German Patent No. 2,748,430; polyamine compounds described in Japanese Patent Publication for Opposition Purpose (hereinafter referred to as 'J.P. KOKOKU' No.) 45-8836; and bromide ion. Among these, the compounds having a mercapto group or disulfide linkage are preferred, since they have a remarkable acceleration effect. Particularly those described in U.S. Pat. No. 3,893,858, West German Patent No. 1,290,812 and J.P. KOKAI No. 53-95630 are preferred. Further the compounds described in U.S. Pat. No. 4,552,834 are also preferred. These bleaching accelerators may be incorporated in the photosensitive material. These bleaching accelerators are particularly effective when a photographic color photosensitive material is to be bleach-fixed.

The fixing agents include, for example, thiosulfates, thiocyanates, thioether compounds, thioueras and a large amount of iodides. Among them, the thiosulfates are usually used and particularly ammonium thiosulfate is most widely usable. The preservatives for the bleach-fixing solution are preferably sulfites, bisulfites and carbonyl bisulfite adducts.

Washing with water and/or stabilization step:

After the photosensitive material is processed as described above, it is washed with water and/or stabilized if necessary in the present invention. The quantity of water used in this step is variable over a wide range depending on the properties of the photosensitive material (such as materials used, e.g. the coupler), use, temperature of the washing water, number of washing tanks (number of stages) and manner of supply (e.g. counter current supply or parallel supply. The relationship between the number of the washing tanks and the quantity of water in the multi-stage counter current process can be determined by a method described in Journal of the Society of Motion Picture and Television Engineers, Vol. 64, pages 248 to 253 (May, 1955).

Although the quantity of washing water can be markedly reduced by the multi-stage counter current method described in the above literature, bacteria are propagated in the tanks because the residence time of water in the tanks is prolonged and a suspended matter thus formed attaches to the photosensitive material. In the processing of the color photosensitive material of the present invention, this problem can be very effectively solved by a process wherein the amount of calcium ion and magnesium ion is reduced as described in J.P. KOKAI No. 62-288838. Further also usable are isothiazolone compounds and thiabendazoles described in J.P. KOKAI No. 57-8542, chlorinated germicides such as sodium chloroisocyanurate and other germicides such as benzotriazole described in Hiroshi Horiguchi, 'Bokin Bobai no Kagaku'; 'Biseibutsu no Mekkin, Sakkin, Bobai Gijutsu' edited by Eisei Gijutsu Kai and 'Bokin Bobaizai Jiten' edited by Nippon Bokin Bobai Gakkai.

The pH of the washing water used is 4 to 9, preferably 5 to 8. The temperature of the washing water and the washing time, which can be varied depending on the properties of the photosensitive material and the use are usually 15° to 45° C., and 20 sec to 10 min, preferably 25° to 40° C. preferably 30 sec to 5 min, respectively. The photosensitive material of the present invention can be directly processed with a stabilizing solution without washing with water. The stabilization can be conducted by a known method described in J.P. KOKAI Nos. 57-8543, 58-14834 and 60-220345.

If necessary, the step of washing with water is followed by the stabilization step with, for example, a stabilization bath containing formalin and a surfactant usually used as the final bath for processing a photographing color photosensitive material. A chelating agent and an antifungal agent can be added also to the stabilization bath.

An overflow formed by the replenishment of the washing water and/or stabilizing solution can be reused in the desilverization step or the like. The stabilization can be effected also by the application method.

Drying step

After the washing with water and/or stabilization, the photosensitive material is dried by an ordinary method at room temperature to 90° C. for 10 sec. to 10 min. The drying step may be omitted.

The present invention is characterized in that the color developer is applied to form a coating layer having a thickness of at most 20 times, preferably 2 to 15 times and more preferably 2 to 10 times that of the photosensitive layer of the photosensitive material. It is generally preferable to apply the color developer in an amount of 1 to 3 equivalents, more preferably 1 to 2 equivalents, per equivalent of silver incorporated in the photosensitive material. With such an amount of the color developer, the concentration thereof can be high and the washing load can be reduced. In this connection, the developer is disposable and is not reused.

When the molar ratio of the developing agent contained in the color developer to the coupled contained in the photosensitive material is controlled to 2.5 or below, preferably in the range of 2 to 1, a sufficient activity can be exhibited and such a molar ratio is economically advantageous in the present invention.

The color developer can be applied to the photosensitive material by an ordinary method such as Viscomat system wherein the solution is applied by hopper-coating or Bimat system wherein a web coated with the solution to form a thin layer is put on the photosensitive material. These methods were developed by Eastman Kodak Co. and are now practically employed.

In the present invention, solutions can be applied to the photosensitive material in the steps following the color development step. This method is preferred, since the amount of the waste solutions can be markedly reduced. In particular, after the color developer is applied to the photosensitive material, the bleaching solution, bleach-fixing solution, fixing solution, etc. are applied thereto to a thickness of 1 to 200μ, preferably 10 to 100μ and more preferably 20 to 70μ, then the aqueous solution and stabilizing solution are applied thereto to the same thickness as that described above and finally the liquid remaining on the photosensitive material is removed by means of a roller coater or the like. The desilverization and/or washing and stabilization can be conducted by ordinary methods with tanks.

The present invention can be employed also in a simplified process wherein the bleaching and fixing (or bleach-fixing), or fixing is omitted. Such a simplified process has a merit in that no tank is necessitated in the two steps. Further the process can be conducted by using only a disposable stabilization bath (or washing water) tank of non-replenishment type after the development by the application method. In both cases, the simplified process is possible owing to the advantages of the present invention.

The color photosensitive materials to be processed by the present invention include, for example, color papers, color reversal papers, photographing color negative films and color reversal films. The present invention is particularly suitable for the rapid, simplified processing of printing photosensitive materials such as color papers.

Any of known silver halide emulsions for photosensitive material can be used in the present invention. In processing a photosensitive material for color prints, a silver chlorobromide emulsion is preferred (for the rapid process, the silver chloride content is at least 90 molar %), and in processing a photographic photosensitive material, a silver bromoiodide emulsion is preferred (the silver iodide content is preferably 2 to 15 molar %). The silver halide grains are spherical, cubic, octahedral, rhombododecahedral or tetradecahedral. The silver halide grains of a highly sensitive photosensitive material are preferably tubular (having an aspect ratio or preferably 5 to 20). The grains may have either a homogeneous phase or a multi-layer structure. They may be of either surface latent image type or inner latent image type. The grain size distribution may be either polydisperse or monodisperse type (preferably standard deviation/average grain size $\leqq$ 15%). The latter is preferred to the former. The silver halide grains may be used singly or in the form of a mixture of them depending on the purpose. The process of the present invention is suitable for processing a photosensitive material having a low silver content of, for example, 0.8 g/m$^2$ or below and particularly of 0.4 g/m$^2$ or below. In processing the photosensitive material having such a low silver content, the bleach-fixing after treatment can be omitted.

The photographic emulsion can be prepared by a method described in Research Disclosure (RD), Vol. 176, Item No. 17643 (Paragraphs I, II and III) (December, 1978).

An emulsion which has been physically or chemically aged and spectrally sensitized can be used. Additives usable in these steps are described in the portions of Research Disclosure, Vol. 176, No. 17643 (December, 1978) and Vol. 187, No. 18716 (November, 1979), as shown in the Table below.

Known photographic additives usable herein are also described in the two volumes of Research Disclosure, and the places where they are described are also shown in the following Table.

| Additive | RD 17643 | RD 18716 |
|---|---|---|
| 1 Chemical sensitizer | p. 23 | p. 648, right column |
| 2 Sensitivity increasing agent | " | " |
| 3 Spectral sensitizer | pp. 23 to 24 | p. 648, right column to p. 649, right column |
| 4 Supersensitizer | " | p. 648, right column to p. 649, right column |
| 5 Brightener | p. 24 | p. 648, right column to p. 649, right column |
| 6 Antifoggant and stabilizer | pp. 24 to 25 | p. 649, right column |
| 7 Coupler | p. 25 | " |
| 8 Organic solvent | p. 25 | " |
| 9 Light absorber, Filter and dye | pp. 25 to 26 | p. 649, right column to p. 650, left column |
| 10 Ultraviolet ray absorber absorber | " | p. 649, right column to p. 650, left column |
| 11 Antistaining agent | p. 25, right column | p. 650, left column to right column |
| 12 Color image stabilizer | p. 25 | p. 650, left column to right column |
| 13 Hardener | p. 26 | p. 651, left column |

-continued

| Additive | RD 17643 | RD 18716 |
|---|---|---|
| 14 Binder | p. 26 | " |
| 15 Plasticizer, lubricant | p. 27 | p. 650, right column |
| 16 Coating assistant, surfactant | pp. 26 to 27 | " |
| 17 Antistatic agent | p. 27 | " |

Various color couplers can be incorporated into the color photosensitive material. Examples are described in the patents referred to in the above-described Research Disclosure (RD) No. 17643. VII-C to G. Important color-forming couplers are those forming primary colors (subtractive) (namely, yellow, magenta and cyan) in the color development. Preferred nondiffusing, 4-equivalent or 2-equivalent couplers include those described in the patents referred to in the above-described RD 17643, VII-C and D and those which will be described below.

Typical examples of the yellow couplers usable herein include known oxygen atom-eliminating type yellow couplers and nitrogen atom-eliminating type yellow couplers. α-Pivaloylacetoanilide couplers form dyes having an excellent fastness to particular light and α-benzoylacetoanilide couplers yield a high color density.

Examples of the magenta couplers usable herein include hydrophobic 5-pyrazolone or pyrazoloazole couplers having a ballast group. Among the 5-pyrazolone couplers, those substituted with an arylamino group or acylamino gorup at the 3-position are preferred from the viewpoints of the hue and color density.

The cyan couplers usable herein are hydrophobic, nondiffusible naphthol or phenol couplers. Typical examples of the preferred cyan couplers are oxygen atom-eliminating type divalent naphthol couplers. Couplers capable of forming cyan dyes having a high fastness to humidity and temperature are preferably used and typical examples include phenolic cyan couplers having an alkyl group other than ethyl group at the m-position of the phenol nucleus described in U.S. Pat. No. 3,772,002, 2,5-diacylamino-substituted phenolic couplers, phenolic couplers having a phenylureido group at the 2-position and an acylamino group at the 5-position, and 5-amidonaphthol cyan couplers described in European Patent No. 161626 A.

The graininess can be improved by using the above-described coupler in combination with a coupler capable of forming a dye having a suitable diffusivity. Examples of these couplers include magenta couplers described in U.S. Pat. No. 4,366,237 and yellow, magenta or cyan couplers described in European Patent No. 96,570.

The dye-forming couplers and the above-described particular couplers may form a dimer or higher polymer. Typical examples of the polymerized dye-forming couplers are described in U.S. Pat. No. 3,451,820, etc. Examples of the polymerized magenta couplers are described in U.S. Pat. No. 4,367,282, etc.

Further couplers capable of releasing a photographically effective residue during the coupling are also preferably usable in the present invention. As DIR couplers which release a development inhibitor, those described in patents described in the above RD 17643, VII-F are usable.

For the photosensitive materials to be processed by the present invention, couplers which release a nucleating agent or development accelerator to form an image or a precursor thereof can be used. Examples are described in British Patent Nos. 2,097,140 and 2,131,188.

In addition, couplers which release DIR redox compound as described in J.P. KOKAI No. 60-185950 and couplers which release a dye capable of recoloring after the elimination as described in European Patent No. 173302 A are also usable.

The present invention thus provides a process for coating development of a silver halide color photosensitive material wherein the amount of the developer used is smaller than that used in an ordinary coating development process, the amount of the waste developer can be reduced or no waste developer is formed, and the development can be conducted in a short time.

The following non-limitative examples will further illustrate the present invention. Since the process can be simplified, the control becomes easy and the development can be conducted at a low cost. The process of the present invention can be conducted even at a place where it is difficult to provide discharge pipes, such as in an office.

EXAMPLES

EXAMPLE 1

A color paper comprising seven layers described as Sample P2 in Example 2 of J.P. KOKAI No. 63-70857 (EP00248450A) was developed by the process described below.

The solutions had the following compositions:

| Color developer | |
|---|---|
| sodium sulfite | 1.5 g |
| sodium bromide | 0.5 g |
| potassium carbonate | 7.0 g |
| 3-methyl-4-amino-N-ethyl-N-β-hydroxyethylaniline sulfate | 8.3 g |
| 3-methyl-4-amino-N-ethyl-N-β-methanesulfonamidoethylaniline 3/2 sulfate monohydrate | 22.0 g |
| hydroxylamine sulfate | 1.5 g |
| potassium hydroxide | 11 g |
| benzyl alcohol | 6 g |
| diethylene glycol | 2 g |
| fluorescent brightener (stilbene compound) | 4 g |
| diethylenetriaminepentaacetic acid | 0.5 g |
| water | ad 1 l |

The pH of the color developer was controlled to 10.1 with potassium hydroxide.

The ionic strength of the color developer was 0.4 and the immersion bath potential was −290 mV.

| Bleach-fixing solution: | |
|---|---|
| ammonium thiosulfate (70% w/v) | 150 ml |
| sodium sulfite | 10 g |
| iron ammonium EDTA | 40 g |
| water | ad 1 l |
| pH | 6.8 |
| Washing water: | |
| city water. | |

The photosensitive material was processed with the above-described solutions. Namely, 40 μm thick coating of the color developer (3.2 times as thick as the dry photosensitive layer) was applied to the photosensitive material (40° C., 60 sec). Then the material was processed with the bleach-fixing solution (40 sec) and washing water (60 sec) by the disposable tank method without replenishment.

After drying, a uniform color image was obtained, though the time taken from the development to the washing was as short as 2 min 40 sec. The color reproducibility was also excellent. The amount of the waste developer was as small as 30 ml per $m^2$ of the photosensitive material, 20 $m^2$ of the material could be processed with 1 l of the bleach-fixing solution and 2 $m^2$ thereof could be processed with 1 l of washing water in the simple apparatus.

COMPARATIVE EXAMPLE 1

Saturated developers a to c were prepared from the same components as those of Example 1 except that the developing agent was changed as follows:

a: 3-methyl-amino-N,N-diethylaniline sulfate b: 4-amino-N,N-diethylaniline sulfate c: a mixture of a and b in a ratio of 1/1.

The development was conducted in the same manner as that of Example 1 with the developer a, b or c.

COMPARATIVE EXAMPLE 2

The same procedure as that of Example 1 was repeated except that the amount of potassium carbonate in the developer was changed from 7 g to 35 g, that the pH was controlled to 10.1 with sodium hydroxide and that the ionic strength was changed to 0.9. The color density was about 85% based on that of Example 1.

The color densities of the photosensitive materials developed in Example 1 and Comparative Examples 1 and 2 were determined. The results are summarized in Table 1.

TABLE 1

| | Color density | | |
|---|---|---|---|
| | Red filter light density | Green filter light density | Blue filter light density |
| Example 1 | 2.55 | 2.15 | 2.40 |
| Comp. Ex. 1 a | 1.80 | 1.50 | 1.65 |
| Comp. Ex. 1 b | 1.60 | 1.40 | 1.55 |
| Comp. Ex. 1 c | 1.80 | 1.50 | 1.70 |
| Comp. Ex. 2 | 2.10 | 1.75 | 2.00 |

EXAMPLE 2

The coating development and tank processing were conducted in the same manner as that of Example 1 except that a color paper described below was used.

A multi-layer color photographic printing paper having a layered structure which will be shown below on a paper support having both surfaces laminated with polyethylene was prepared. The coating solution was prepared as follows:

Preparation of coating solution for forming the first layer:

27.2 ml of ethyl acetate and 8.2 g of a solvent (Solv-3) were added to a mixture of 19.1 g of a yellow coupler (ExY), 4.4 g of a color image stabilizer (Cpd-1) and 0.7 g of a color image stabilizer (Cpd-7) to form a solution. The solution was emulsion-dispersed in 185 ml of 10% aqueous gelatin solution containing 8 ml of 10% sodium dodecylbenzenesulfonate. Separately, $2.0\times10^{-4}$ mol, per mol of silver, of the following blue-sensitive sensitizing dye was added to a silver chlorobromide emulsion (having an average cubic grain size of 0.88 μm, and coefficient of variation of grain size distribution of 0.08 and containing 0.2 molar % of silver bromide on the grain surface) and the mixture was sensitized with sulfur. The emulsified dispersion and the emulsion prepared as described above were mixed together to form a solution having a composition shown below which was to be used as the first layer-forming coating solution. The coating solutions for forming the second to the seventh layers were prepared in the same manner as that described above. Sodium 1-hydroxy-3,5-dichloro-s-triazine was used as the hardener for gelatin in each layer.

The spectral sensitizing dyes in the respective layers were as follows:

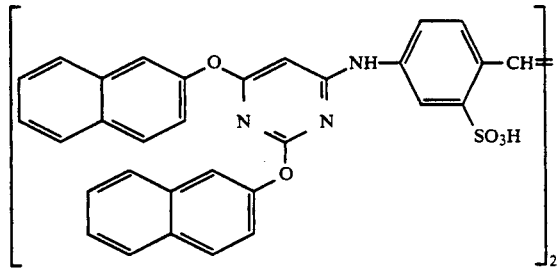

Blue-sensitive emulsion layer:

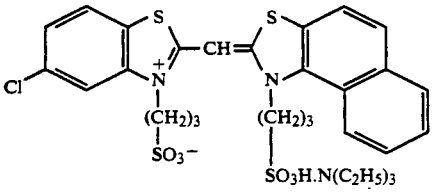

and

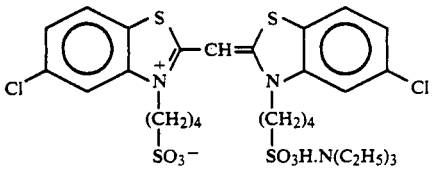

(each $2.0 \times 10^{-4}$ mol per mol of the silver halide)

Green-sensitive emulsion layer:

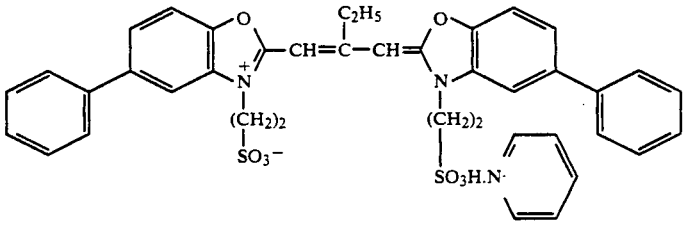

($4.0 \times 10^{-4}$ mol per mol of the silver halide)

and

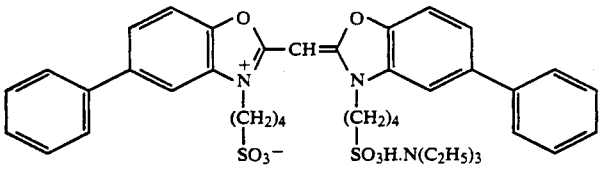

($7.0 \times 10^{-5}$ mol per mol of the silver halide)

Red-sensitive emulsion layer:

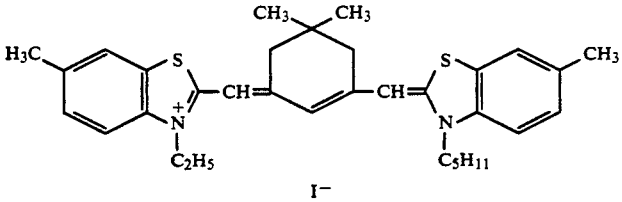

($0.9 \times 10^{-4}$ mol per mol of the silver halide)

$2.6 \times 10^{-3}$ mol, per mol of the silver halide, of the following compound was added to the red-sensitive emulsion layer:

$8.5 \times 10^{-5}$ mol, $7.7 \times 10^{-4}$ mol and $2.5 \times 10-4$ mol, per mol of the silver halide, of 1-(5-methylureidophenyl)-5-mercaptotetrazole was added to the blue-sensitive emulsion layer, green-sensitive emulsion layer and red-sensitive emulsion layer, respectively.

For preventing the irradiation, the following dyes were added to the emulsion layer:

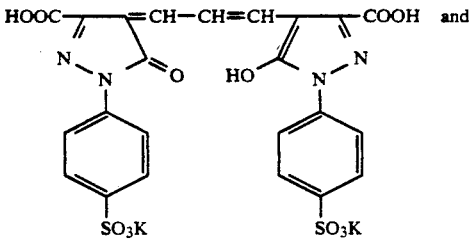

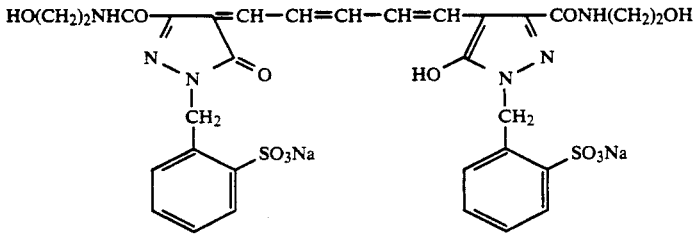

Layer structure

The composition of each layer is shown below. The numerals represent the amount of coating (g/m$^2$). The amount of the silver halide emulsion is shown in terms of the amount of silver used for the coating.

| Support: | |
|---|---|
| Polyethylene-laminated paper [containing a white pigment ($TiO_2$) and a blue dye (ultramarine) in the polyethylene layer on the first layer side] | |
| The first layer (blue-sensitive layer) | |
| silver chlorobromide emulsion | 0.30 |
| gelatin | 1.86 |
| yellow coupler (ExY) | 0.82 |
| color image stabilizer (Cpd-1) | 0.19 |
| solvent (Solv-3) | 0.35 |
| color image stabilizer (Cpd-7) | 0.06 |
| The second layer (color-mixing inhibiting layer) | |
| gelatin | 0.99 |
| color mixing inhibitor (Cpd-5) | 0.08 |
| solvent (Solv-1) | 0.16 |
| solvent (Solv-4) | 0.08 |
| The third layer (green-sensitive layer) | |
| silver chlorobromide emulsion [mixture of cubic grains having average grain size of 0.55 μm and those of 0.39 μm in a molar ratio of 1:3 (in terms of Ag)] (having coefficient of variation of grain size distribution of 0.10 and 0.08) (0.8 molar % of AgBr was locally incorporated in the surface layer of the grain) | 0.12 |
| gelatin | 1.24 |
| magenta coupler (ExM) | 0.27 |
| color image stabilizer (Cpd-8) | 0.02 |
| color image stabilizer (Cpd-9) | 0.03 |
| solvent (Solv-2) | 0.54 |
| The fourth layer (U.V. absorbing layer) | |
| gelatin | 1.58 |
| U.V. absorber (UV-1) | 0.47 |
| color mixing inhibitor (Cpd-5) | 0.05 |
| solvent (Solv-5) | 0.24 |
| The fifth layer (red-sensitive layer) | |
| silver chlorobromide emulsion [mixture of cubic grains having average grain size of 0.58 μm and those 0.45 μm in a molar ratio of 1:4 (in terms of Ag)] (having coefficient of variation of grain size distribution of 0.09 and 0.11) (the grain surface partially contains 0.6 molar % of AgBr) | 0.23 |
| gelatin | 1.34 |
| cyan coupler (Exc) | 0.32 |
| color image stabilizer (Cpd-6) | 0.17 |
| color image stabilizer (Cpd-10) | 0.04 |
| color image stabilizer (Cpd-7) | 0.40 |
| solvent (Solv-6) | 0.15 |
| The sixth layer (U.V.-absorbing layer) | |
| gelatin | 0.53 |
| U.V. absorber (UV-1) | 0.16 |
| color mixing inhibitor (Cpd-5) | 0.02 |
| solvent (Solv-5) | 0.08 |
| The seventh layer (protective layer) | |
| gelatin | 1.33 |
| acryl-modified polyvinyl alcohol copolymer (degree of modification: 17%) | 0.17 |
| liquid paraffin | 0.03 |

-continued

| Support: | |
|---|---|
| color image stabilizer (Cpd-3) | 0.15 |

A mixture of the following couplers in a weight ratio of 2:4:4:

(ExY) Yellow coupler

-continued
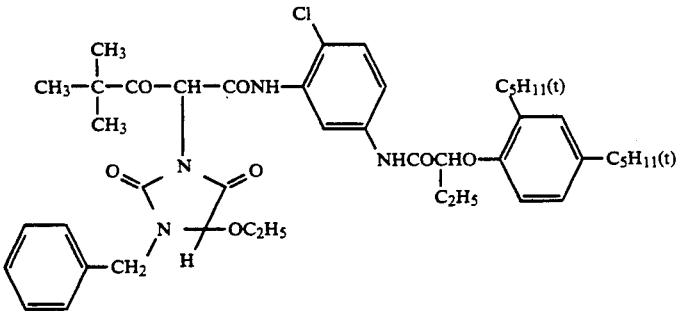
(ExM) Magenta coupler
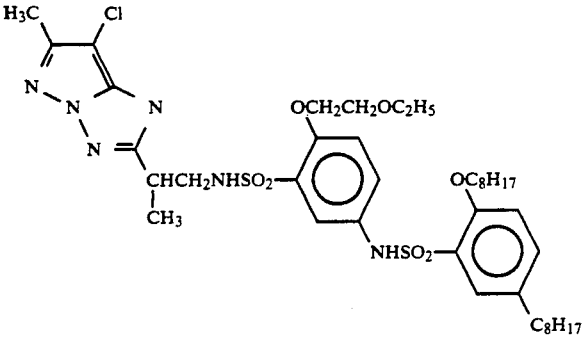
and
(ExC) Cyan coupler
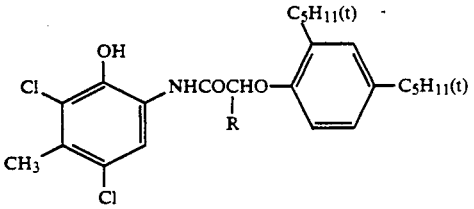
R = $C_2H_5$, $C_4H_9$
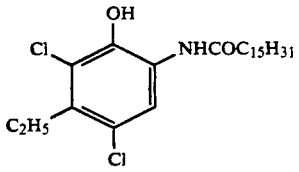
(Cpd-1) Color image stabilizer
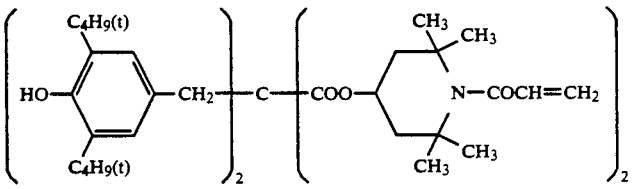
(Cpd-3) Color image stabilizer
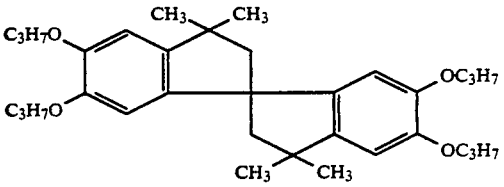
(Cpd-5) Color mixing inhibitor -continued
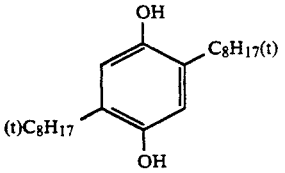
(Cpd-6) Color mixing inhibitor:
(A mixture of the following compounds in a weight ratio of 2:4:4)
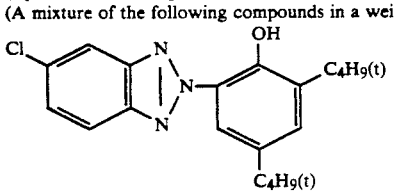
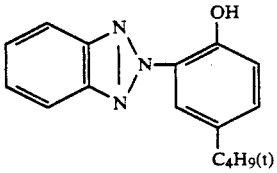
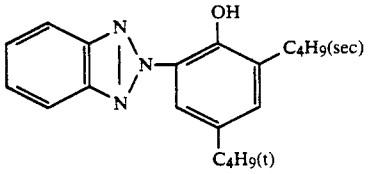
(Cpd-7) Color image stabilizer
$$\left(CH_2-\underset{\underset{CONHC_4H_9(t)}{|}}{CH}\right)_n$$
average molecular weight: 60,000
(Cpd-8) Color image stabilizer
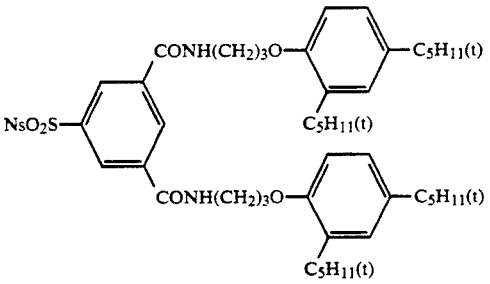
(Cpd-9) Color image stabilizer
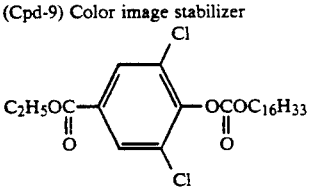
(Cpd-10) Color image stabilizer
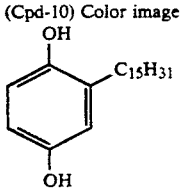
(UV-1) UV absorber
(A mixture of the following compounds in a weight ratio of 4:2:4)

-continued

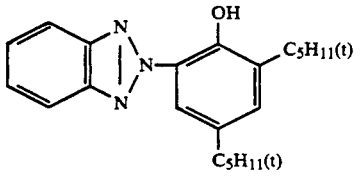

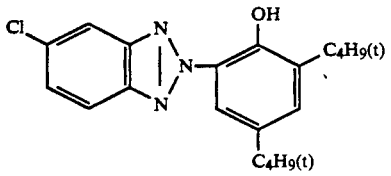

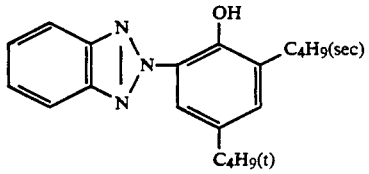

Solvent
(A mixture of the following compounds in a volume ratio of 2:1)
(Solv-1) Solvent

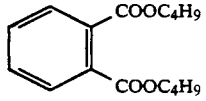

(Solv-2) Solvent

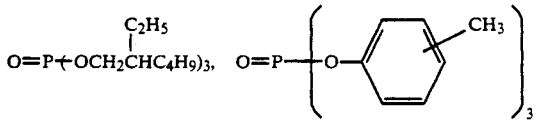

(Solv-3) Solvent
$O{=}P{\leftarrow}O{-}C_9H_{19}(iso))_3$ (Solv-4) Solvent

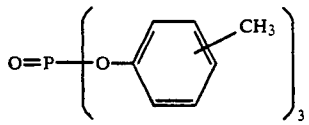

(Solv-5) Solvent
$COOC_8H_{17}$
|
$(CH_2)_8$
|
$COOC_8H_{17}$ (Solv-6) Solvent

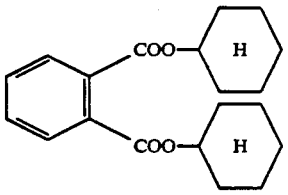

The above-described color paper was developed to form a uniform color image. A good color reproducibility was obtained. The amount of the waste developer was as small as 30 ml per $m^2$ of the photosensitive material.

EXAMPLE 3

A color paper comprising seven layers described in Example 2 of J.P. KOKAI No. 63-108339 (Japanese Patent Application No. 61-254878) was developed by the process described below.

The solutions had the following compositions:

| Color developer | |
|---|---|
| sodium sulfite | 0.05 g |
| potassium carbonate | 8 g |
| 3-methyl-4-amino-N-ethyl-N-β-hydroxyethylaniline sulfate | 9.5 g |
| 3-methyl-4-amino-N-ethyl-N-β-methanesulfonamidoethylaniline 3/2 sulfate monohydrate | 4.0 g |
| potassium hydroxide | 5.0 g |
| fluorescent brightener (stilbene compound) | 4 g |
| hydroxymethylcellulose | 1 g |
| water | ad 1 l |

The pH of the color developer was controlled to 10.5 with potassium hydroxide.

The ionic strength of the color developer was 0.28 and the immersion bath potential was −300 mV.

Bleach-fixing solution:

The same bleach-fixing solution as that used in Example 1 was used.

| Stabilizing solution: | |
|---|---|
| citric acid | 3 g |
| potassium hydroxide | 0.15 g |
| 3-chloro-2,3-dimethylphenol | 0.1 g |
| water | ad 1 l |

The photosensitive material was processed with the above-described solutions. Namely, a holding sheet was put on the color paper through a 100 μm spacer and a pot containing 1 ml of the developer was inserted between them. They were spread with an opposing type roller at room temperature for 20 sec. Then the holding sheet was peeled off and the color paper was bleach-fixed and stabilized by the disposable solution method without using any replenisher, each for 30 sec, to obtain a color print having an excellent color tone.

In this method, the developer was applied to a thickness of 9 times that of the photosensitive layer of the photosensitive material (on dry basis) (molar ratio of the developing agent to the coupler was 1.3)

EXAMPLE 4

The same procedure as that of Example 1 was repeated except that the color paper was replaced with the direct positive color photosensitive material described in Example 1 of Japanese Patent Application No. 62-71041 (YQ 0778; EP00285010A) and that the processing solutions described also therein were used. The results were similar to those of Example 1.

EXAMPLE 5

The same procedure as that of Example 1 was repeated except that 5 g/l of $Na_2S_2O_3$ was added to the developer and that the bleach-fixing step was omitted.

The color print thus obtained had a red filter light density of 2.05, green filter light density of 2.00 and blue filter light density of 1.90.

What is claimed is:

1. A process for coating development of a silver halide color photosensitive material by coating said silver halide color photosensitive material with color developer to form a thin film, said process comprising:

imagewise exposing said silver halide color photosensitive material, applying a color developer comprising a developing agent consisting essentially of a p-phenylenediamine developing agent having a group capable of imparting hydrophilic properties selected from the group consisting of 3-methyl-4-amino-N-ethyl-N-β-hydroxyethylaniline, 3-methyl-4-amino-N-ethyl-N-β-methanesulfonamidoethylaniline, 3-methyl-4-amino-N-N-di-β-hydroxyethylaniline, 3-β-methanesulfonamidoethyl-4-amino,N,N-diethylaniline, 3-sulfoethyl-4-amino-N,N-diethylaniline, 3-carboxyethyl-4-amino-N,N-diethylaniline, 3-methyl-4-amino-N-ethyl-N-sulfoethylaniline, sulfates thereof, hydrochlorides thereof, p-toluenesulfonates thereof and phosphates thereof, to said imagewise exposed photosensitive material, wherein said color developer has an ionic strength of 0.8 or below, to form a coating film which has a thickness of at most 20 times the thickness of the dry photosensitive layer of the photosensitive material and an electric potential of −280 mV to −400 mV, based on a standard electrode, when an unreactive electrode is immersed in said color developer.

2. The method of claim 1, which further comprises the steps of desilvering said photographic material, washing and/or stabilizing said photographic material and drying said photographic material.

3. The method of claim 1, wherein the silver halide color photosensitive material comprises non-diffusible color couplers.

4. A process of claim 1 wherein the amount of the developing agent in the developer is at least 5m mol.

5. A process of claim 4 wherein the amount of the developing agent in the developer is 0.01 to 0.2 mol.

6. A process of claim 1 wherein the color developer has an ionic strength of 0.1 to 0.5.

7. A process of claim 1 wherein the silver halide color photosensitive material to be coating-developed has a silver halide content of 0.8 g/m$^2$ or below.

8. A process of claim 1 wherein the color developer is applied to form a coating layer having a thickness of 2 to 15 times that of the photosensitive layer of the photosensitive material.

9. A process of claim 1 wherein the color developer is applied in an amount of 1 to 3 equivalents per equivalent of silver present in the photosensitive material.

10. A process of claim 1 wherein the molar ratio of the developing agent in the color developer to coupler in the photosensitive material is controlled to 2.5 or below.

11. A process of claim 10 wherein the molar ratio is controlled to 2 to 1.

* * * * *